US008805245B2

(12) United States Patent
Miyake

(10) Patent No.: US 8,805,245 B2
(45) Date of Patent: Aug. 12, 2014

(54) CHARGING DEVICE AND IMAGE FORMING APPARATUS USING THE SAME

(75) Inventor: Koji Miyake, Yokohama (JP)

(73) Assignee: Samsung Electronics Co., Ltd., Suwon-Si (KR)

( * ) Notice: Subject to any disclaimer, the term of this patent is extended or adjusted under 35 U.S.C. 154(b) by 334 days.

(21) Appl. No.: 13/200,923

(22) Filed: Oct. 5, 2011

(65) Prior Publication Data

US 2012/0155922 A1 Jun. 21, 2012

(30) Foreign Application Priority Data

Dec. 16, 2010 (JP) ..... 2010-280936
May 6, 2011 (KR) ..... 10-2011-0043080

(51) Int. Cl.
*G03G 15/02* (2006.01)
*B65H 43/04* (2006.01)
*B65H 5/04* (2006.01)

(52) U.S. Cl.
USPC ..... 399/176; 271/198; 271/275

(58) Field of Classification Search
USPC ..... 399/176; 492/21; 271/198, 275; 198/808, 824
See application file for complete search history.

(56) References Cited

U.S. PATENT DOCUMENTS

2002/0037180 A1* 3/2002 Amemiya et al. ..... 399/176
2010/0247169 A1* 9/2010 Hayashi ..... 399/302

FOREIGN PATENT DOCUMENTS

JP 4-268584 9/1992
JP 8-146709 6/1996
JP 10063142 A * 3/1998 ..... G03G 21/00
JP 11-352748 12/1999
JP 2002-55510 2/2002
JP 2010-2581 1/2010

OTHER PUBLICATIONS

Machine translation of Hayakawa et al., JP H10-063142 (1998).*

* cited by examiner

*Primary Examiner* — David Gray
*Assistant Examiner* — Sevan A Aydin
(74) *Attorney, Agent, or Firm* — Staas & Halsey LLP

(57) ABSTRACT

A roll-type charging device contacts an image receptor serving as a body to be charged and is capable of rotating due to rotation of the image receptor. The apparatus includes a hollow roll having a cylindrical shape and formed of a hollow elastic member and flanges having rotation axes and formed of elastic members, the flanges inserted into two ends of the hollow roll to increase an inner diameter of the hollow roll.

12 Claims, 5 Drawing Sheets

CHARGING DEVICE AND IMAGE FORMING APPARATUS USING THE SAME

CROSS-REFERENCE TO RELATED APPLICATIONS

This application claims the benefit of Japanese Patent Application No. 2010-280936, filed on Dec. 16, 2010, in the Japanese Patent Office and Korean Patent Application No. 10-2011-0043080, filed on May 6, 2011, in the Korean Intellectual Property Office, the disclosures of which are incorporated herein in their entirety by reference.

BACKGROUND

1. Field

The present disclosure relates to a charging device and an image forming apparatus, and more particularly, to a roll-shaped charging device and an image forming apparatus using the same.

2. Description of the Related Art

In a conventional printer using toner, a charging member having a roll shape, a brush shape, or a blade shape to which a charging voltage is applied may be brought into contact with a photosensitive body while applying a predetermined weight to the photosensitive body. Discharging may occur in a fine gap adjacent to a contact portion between the charging member and the photosensitive body to enable charging of the photosensitive body.

For example, (Japanese Patent Publication No. 04-268584 discloses a technique in which a charging member includes an internal conductive roller and a tube roller having a portion surrounding the conductive roller and rotatably installed and the tube roller is pressed against a photosensitive body by the internal conductive roller to induce charging. Also, Japanese Patent Publication No. 2002-55510 discloses a configuration for increasing the hardness of a member corresponding to a tube.

In addition, Japanese Patent Publication No. 11-352748 describes a configuration in which a plurality of limiting rollers are installed in a conductive charging film to support the conductive charging film and limit a nip location with respect to a photosensitive body.

Furthermore, Japanese Patent Publication No. 2010-2581 describes a configuration in which a shaft-less hollow roller is positionally limited by an external casing and brought into contact with a photosensitive body.

Moreover, Japanese Patent Publication No. 8-146709 discloses a configuration in which an end portion of a hollow tube roller is fixed to a flange not in direct contact with the tube roller using a rubber ring installed around the flange. In this configuration, the flange may be connected to a through shaft, and electricity may be supplied from the through shaft via the flange.

However, in the technique in which a charging member is pressed against a photosensitive body while applying a weight to the photosensitive body and rotated to enable uniform charging, since pressure is applied to the entire charging member, the applied weight is increased, thereby facilitating abrasion of a surface of the charging member. In particular, when a solid charging roller is used instead of a hollow charging roller, pressure applied to the vicinity of a center of the solid charging roller in an axial direction may be reduced and thus it may be necessary to increase a weight applied to the charging roller, and thus a surface of the solid charging roller may be easily worn away and damaged. Also, since charging depends on occurrence of discharge in a fine gap, the charging member may be degraded due to discharge stress. In addition, when a relatively heavy weight is applied, extraneous matter, such as a carrier, may be caught in a contact portion, thereby causing scratches on a surface of a photosensitive body. Furthermore, surface filming due to a discharge generator or an external additive may lead to deterioration of image quality. Also, if a relatively heavy weight is applied, a compressed portion of a charging roller may be deformed during transfer or storage, that is, only a portion of the charging roller may be distorted. Thus, uniform charging of a photosensitive body may not be possible, thereby degrading image quality.

Furthermore, to enable uniform charging, a charging roller needs to drive or be rotated with respect to a photosensitive body at a uniform speed. However, when a relatively heavy weight is applied, smooth rotation of a charging roller may become difficult, and the charging roller repeatedly performs a stepwise operation of rotating and stopping within a relatively small amount of time. For this reason, charging of a photosensitive body in a desired state may be difficult, thus resulting in deterioration of image quality. In the technique of Japanese Patent Publication No. 04-268584, if an internal roller (or a conductive wire) is rotated, an external tube member (or a tube-shaped resistance member) may be neither uniformly driven nor driven at a uniform speed due to internal fiction. Also, in Japanese Patent Publication No. 2002-55510, which proposes the technique of increasing the hardness of a member corresponding to a tube, the hardness of a fine region corresponding to a contact portion may be increased and thus occurrence of scratches on a photosensitive body may not be suppressed. In addition, by increasing the hardness of a member, a width of a contact portion between the member and a photosensitive body may be reduced, and a charged width of the photosensitive body may be reduced, thus preventing stable charging.

In the technique disclosed in Japanese Patent Publication No. 11-352748, since a film limiting roll is included in a tube-type charging film, uniform rotation may not be possible, as in Japanese Patent Publication No. 04-268584. Also, since pressure applied to the charging film at a pressure contact (or nip location) depends on the hardness of the charging film, the applied pressure may not be stably applied.

In the technique disclosed in Japanese Patent Publication No. 2010-2581, a charging roller is sustained by a casing (or a limiting member). However, since a position of the charging roller is changed within the casing, complicated positional control may be required. Also, since the charging roller always needs to be in contact with the casing, a surface of the charging roller may be worn away and contaminated due to the casing.

Moreover, in the technique disclosed in Japanese Patent Publication No. 08-146709, pressure applied to ends of a conductive tube in an axial direction may differ from pressure applied to a center thereof in the axial direction. In particular, since relatively low pressure is applied to the center of the conductive tube, uniform charging cannot be performed along an axial direction of a charging roller. Also, when a weight is applied to a photosensitive body, an internal rubber ring may be deformed and thus an originally weak nip balance may be easily lost.

SUMMARY

The present disclosure provides a charging device and an image forming apparatus using the same, in which a weight of a charging roller may be uniformly applied over an entire region in an axial direction.

Additional aspects and/or advantages will be set forth in part in the description which follows and, in part, will be apparent from the description, or may be learned by practice of the disclosure.

According to an aspect of the present disclosure, there is provided a charging device having a roll shape and configured to contact an image receptor as a body to be charged and to be capable of rotating due to rotation of the image receptor. The charging device includes a hollow roll having a cylindrical shape and formed of a hollow elastic member and flanges having rotation axes and formed of elastic members, the flanges inserted into two ends of the hollow roll to increase an inner diameter of the hollow roll. In this configuration, when contacted by the image receptor, the flanges may be deformed so that a center of the hollow roll can have a bending force toward the image receptor. Thus, the center of the hollow roll may be compressed to the image receptor due to the bending force, while both ends of the hollow roll may be compressed to the image receptor due to weights applied to the rotation axes of the flanges. Accordingly, a uniform weight may be ensured over the entire axial region by inhibiting a reduction in the weight applied to the center of the hollow roll. Also, an applied pressure may be minimized by compressing the hollow roll to the image receptor and simultaneously, a charged width may be increased.

The hollow roll and at least one of the flanges may have conductivity. In this configuration, a predetermined voltage may be applied to the image receptor via the flanges and the hollow roll.

The flanges may contact the image receptor via the hollow roll and be driven with rotation of the image receptor. In this configuration, the flanges may be driven by the image receptor to charge the image receptor with electricity.

The rotation axes of the flanges may be compressed to the image receptor. In this configuration, both ends of the hollow roll may be pressed against the image receptor by the flanges and simultaneously, a bending force may be caused to the center of the hollow roll due to the deformation of the flanges, and the center of the hollow roll may be compressed to the image receptor due to the bending force.

The flanges may be bonded to the hollow roll. In this configuration, the flanges and the hollow roll may be reliably fixed to each other.

According to another aspect of the present disclosure, there is provided an image forming apparatus including: an image receptor configured to transfer a supplied toner based on an electrostatic latent image and to form an image on a medium; a developing agent receptor configured to supply the toner to the image receptor; and a charging roller configured to contact the image receptor, to rotate due to rotation of the image receptor, and to electrify the image receptor. The charging roller includes: a hollow roll having a cylindrical shape and formed of a hollow elastic member; and flanges having rotation axes and formed of elastic members, the flanges inserted into two ends of the hollow roll to increase an inner diameter of the hollow roll. In this configuration, when contacted by the image receptor, the flanges may be deformed so that a center of the hollow roll can have a bending force toward the image receptor. Thus, the center of the hollow roll may be compressed to the image receptor due to the bending force, while both ends of the hollow roll may be compressed to the image receptor due to weights applied to the rotation axes of the flanges. Accordingly, a uniform weight may be ensured over the entire axial region by inhibiting a reduction in the weight applied to the center of the hollow roll. Also, an applied pressure may be minimized by compressing the hollow roll to the image receptor and simultaneously, a charged width may be increased.

The hollow roll and at least one of the flanges has conductivity. In this configuration, a predetermined voltage may be applied to the image receptor via the flanges and the hollow roll.

The flanges may contact the image receptor via the hollow roll and operate by rotation of the image receptor. The flanges may be driven by the image receptor to charge the image receptor with electricity.

The rotation axes of the flanges may be pressed against the image receptor. In this configuration, both ends of the hollow roll may be compressed to the image receptor by the flanges and simultaneously, a bending force may be caused to the center of the hollow roll due to the deformation of the flanges, and the center of the hollow roll may be compressed to the image receptor due to the bending force.

The flanges may be bonded to the hollow roll. In this configuration, the flanges and the hollow roll may be reliably fixed to each other.

BRIEF DESCRIPTION OF THE DRAWINGS

The above and other features and advantages of the present disclosure will become more apparent by describing in detail exemplary embodiments thereof with reference to the attached drawings in which.

DETAILED DESCRIPTION

Figure 1:
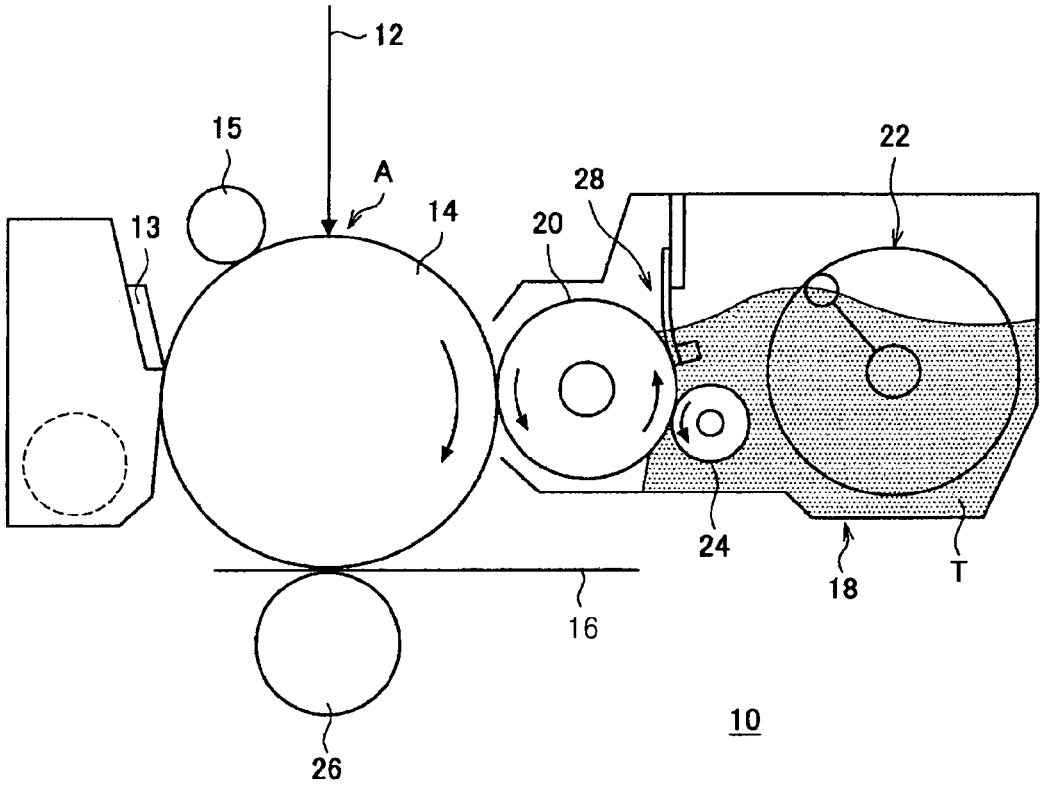
FIG. 1 is a schematic configuration diagram of an image forming apparatus according to an exemplary embodiment of the present disclosure.

The present disclosure will be described more fully hereinafter with reference to the accompanying drawings, in which exemplary embodiments of the disclosure are shown. In the specification and drawings, the same reference numerals are used to denote components having substantially the same functions, thus repeated description thereof will be omitted.

FIG. 1 is a schematic configuration diagram of an image forming apparatus 10 according to an exemplary embodiment of the present disclosure. The image forming apparatus 10 according to the present embodiment may scan a laser beam 12 modulated in response to an image signal onto a photosensitive drum 14 to expose the photosensitive drum 14 and print an image onto a printing medium 16, such as a sheet of paper or a plastic sheet, using a dry electronic photography technique. The image forming apparatus 10 may be a laser printer, a laser fax, a photocopying machine, or a portion thereof.

The image forming apparatus 10 may include a laser exposure unit (not shown) configured to emit the laser beam 12. The laser exposure unit may scan the laser beam 12 in a predetermined direction in a straight line parallel to a rotation axis of the photosensitive drum (or an electrostatic latent image receptor) 14 onto an exposure location A of the photosensitive drum 14. When the laser beam 12 is scanned onto a surface of the photosensitive drum 14, an exposure portion of the photosensitive drum 14 may have an electrostatic potential (e.g., positive potential) different from that of a non-exposure portion thereof. Also, relative positions of the photosensitive drum 14 and a developing roller 20 disposed on a rotating body will now be described on the assumption that a side further in a rotation direction is a downstream side and a side further in a counter-rotation direction is an upstream side.

The photosensitive drum 14 may rotate as indicated by an arrow thereon in FIG. 1. A photosensitive-drum cleaning unit 13 and a charging roller 15 may be disposed at an upstream side of the exposure location A of the photosensitive drum 14. The photosensitive-drum cleaning unit 13 may remove remaining toner from the photosensitive drum 14 and clean the photosensitive drum 14. Also, the charging roller 15 may charge the photosensitive drum 14 to a predetermined electric potential.

A developing unit 18 may be disposed at a downstream side of the exposure location A of the photosensitive drum 14. A powdered developing agent T (e.g., toner) of a predetermined color may be stored in the developing unit 18. The toner T may be, for example, polyester particles having a diameter of about 7 to about 8 μm and may contain a pigment and a charge control agent (CCA). The developing unit 18 may frictionally charge the developing agent T with negative charges and supply the developing agent T to an exposed portion of the surface of the photosensitive drum 14, wherein the exposed portion of the surface of the photosensitive drum 14 exhibits an electrostatic potential different from that of an unexposed portion thereof. Thus, the developing agent T may be attached to the exposed portion of the surface of the photosensitive drum 14.

The developing roller (or developing-agent receptor) 20 configured to supply the charged developing agent T to the photosensitive drum 14 may be installed in the developing unit 18. The developing roller 20 may be in contact with or separated from the surface of the photosensitive drum 14 and rotate as indicated by an arrow thereon in FIG. 1, that is, in a direction counter to the rotational direction of the photosensitive drum 14.

In addition, a stirrer 22 and a supply roller 24 may be installed in the developing unit 18. The stirrer 22 may stir the developing agent T and charge the developing agent T with negative charges, and the supply roller 24 may supply the developing agent T to the developing roller 20. The supply roller 24 may be a roller having a foaming body, such as silicone rubber or urethane rubber. The supply roller 24 may rotate as indicated by an arrow thereon in FIG. 1 and supply the developing agent T stirred and charged by the stirrer 22 to a surface of the developing roller 20. The developing agent T supplied to the developing roller 20 may be attached to the surface of the developing roller 20 due to Coulomb force caused by the charging thereof.

A conveyance roller 26 may be installed opposite to the photosensitive drum 14. The printing medium 16 onto which an image is printed with the developing agent T may be interposed between the photosensitive drum 14 and the conveyance roller 26 and conveyed, and the developing agent T may be fused to the printing medium 16 by a fusing unit (not shown). A plate-type layer regulating member 28 may be in contact with the surface of the developing roller 20 along a rotation axis of the developing roller 20. The layer regulating member 28 may limit a layer thickness of the developing agent T attached to the developing roller 11 to a predetermined thickness and simultaneously allow the developing agent T to pass between the developing roller 20 and the layer regulating member 28 while the developing agent T is exhibiting negative charges.

When the developing agent T attached to the developing roller 20 has passed between the surface of the developing roller 20 and the layer regulating member 28, the developing agent T may have negative charges of about −25 to about −15 μC/g. Also, when the developing agent T passes between the surface of the developing roller 20 and the layer regulating member 28, the developing agent T containing particles with a diameter of about 7 to about 8 μm may have a uniform thickness of about 3 to about 4 particle layers on the surface of the developing roller 20.

As described above, the portion of the photosensitive drum 14 exposed to the laser beam 12 may have an electrostatic potential different from that of the unexposed portion thereof. While the developing agent T charged with negative charges is conveyed to the vicinity of the surface of the photosensitive drum 14 as the developing roller 20 rotates, the developing agent T may be attached to the exposed portion of the photosensitive drum 14. The developing agent T attached to the exposed portion may be supplied to the printing medium 16 as the photosensitive drum 14 rotates. Thus, an image may be printed onto the printing medium 16 with the developing agent T along the portion of the photosensitive drum 14 exposed to the laser beam 12.

Figure 2:
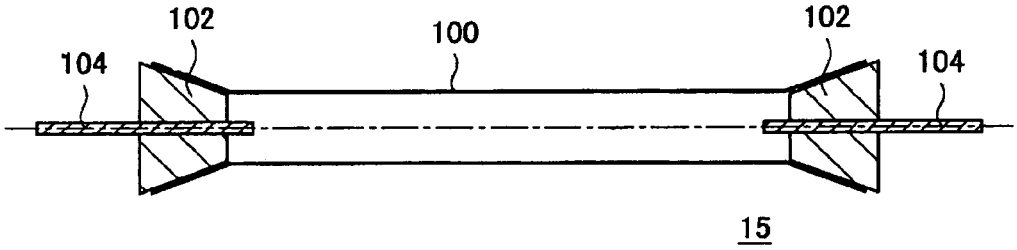
FIG. 2 is a cross-sectional view of a charging roller according to an exemplary embodiment of the present disclosure.

FIG. 2 is a cross-sectional view of the charging roller 15. As shown in FIG. 2, the charging roller 15 may include a hollow roll 100, flanges 102, and rotation axes 104. The hollow roll 100 may be an elastic member formed of an elastic material, such as conductive rubber, and have a hollow pipe shape. The flanges 102 may have conic lateral surfaces and may be respectively inserted into two ends of the hollow roll 100 to broaden both ends of the hollow roll 100.

The flanges 102 may each be an elastic member formed of an elastic material, such as rubber. The rotation axes 104 may be respectively inserted into the two flanges 102. At least a portion of each of the two flanges 102 may be formed of a conductive material. Thus, by applying a voltage to the conductive flanges 102, the photosensitive drum 14 may be electrically charged while in contact with the conductive hollow roll 100. The flanges 102 may be inserted into and in contact with both ends of the hollow roll 100.

Figure 3:
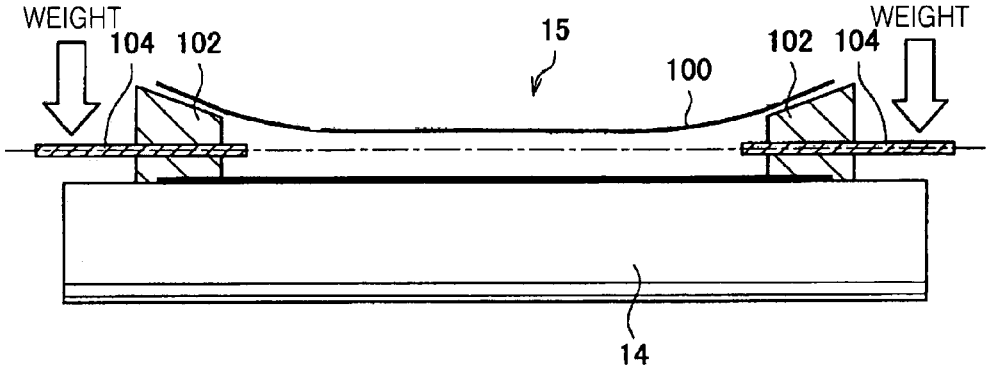
FIG. 3 is a schematic view of a charging roller pressed against a photosensitive drum according to an exemplary embodiment of the present disclosure.

FIG. 3 is a schematic view of the charging roller 15 pressed against the photosensitive drum 14. As shown in FIG. 3, the rotation axes 104 of the charging roller 15 may be pressed toward the photosensitive drum 14 by a pressure force from elastic members, such as compression springs. In this case, the flanges 102 serving as elastic bodies may be deformed due to the pressure force of the compression springs. Thus, as shown in FIG. 3, portions of the flanges 102 in contact with the photosensitive drum 14 may be deformed along the surface of the photosensitive drum 14. Also, the hollow roll 100 may be pressed against the surface of the photosensitive drum 14.

Referring to FIG. 3, a center of the hollow roll 100 may be deformed downward, and a downward force is applied to the center of the hollow roll 100. Meanwhile, the hollow roll 100 may be pressed against the photosensitive drum 14 due to weights applied to the flanges 102 at both ends of the hollow roll 100 by compression springs. Accordingly, the charging roller 15 may be pressed against the photosensitive drum 100 with a uniform force over an entire axial region.

Figure 4A:
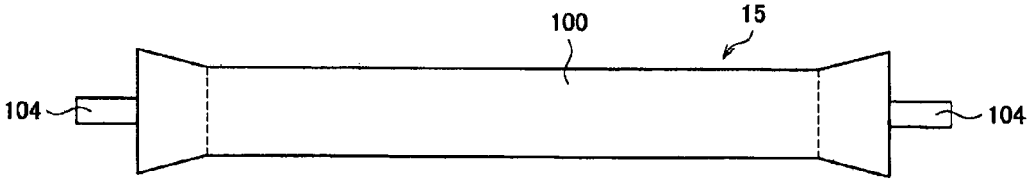
FIGS. 4A through 4C are schematic views for explaining a behavior of a hollow roll pressed against a photosensitive drum according to an exemplary embodiment of the present disclosure.
Figure 4B:
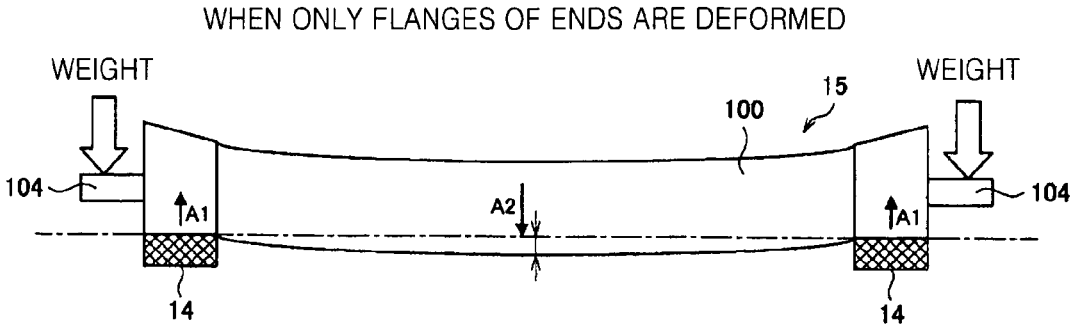
Figure 4C:
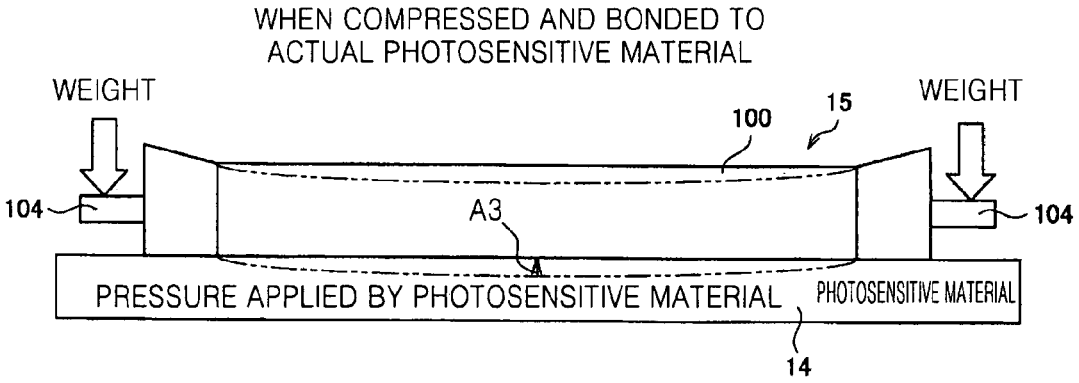

FIGS. 4A through 4C are schematic views for explaining a behavior of the hollow roll 100 pressed against the photosensitive drum 14. Here, FIG. 4A shows a state of the charging roller 15, and FIG. 4B is a schematic view showing an assumption in which only the flanges 102 of ends of the charging roller 15 are pressed against the photosensitive drum 14. As shown in FIG. 4B, when the flanges 102 are compressed, the flanges 102 and the hollow roll 100 may be deformed in the direction of arrows A1 at both ends of the charging roller 15. Thus, the center of the hollow roll 100 may be deformed in the direction of an arrow A2, and thus the hollow roll 100 may be bent in the direction of the arrow A2.

FIG. 4C is a schematic view showing the charging roller 15 actually pressed against the photosensitive drum 14. As shown in FIG. 4B, since the center of the hollow roll 100 is bent in the direction of the arrow A2, the center of the hollow roll 100 may be elastically deformed in the direction of an arrow A3 in a state where the hollow roll 100 is pressed against the photosensitive drum 14. Due to the elastic deformation, the hollow roll 100 may be pressed against the photosensitive drum 14 at a center of the charging roller 15 in an axial direction of the charging roller 15. Meanwhile, the hollow roll 100 may be pressed against the photosensitive drum 14 at both ends of the charging roller 15 due to an elastic bias force of springs. Accordingly, the hollow roll 100 may be pressed against the photosensitive drum 14 at both ends of the charging roller 15 due to the elastic bias force of the springs, while the hollow roll 100 may be pressed against the photosensitive drum 14 at the center of the charging roller 15 due to the elastic deformation of the hollow roll 100. Thus, pressure may be applied even at the center of the hollow roll and uniformly applied to an entire region in an axial direction of the charging roller 15.

Figure 5:
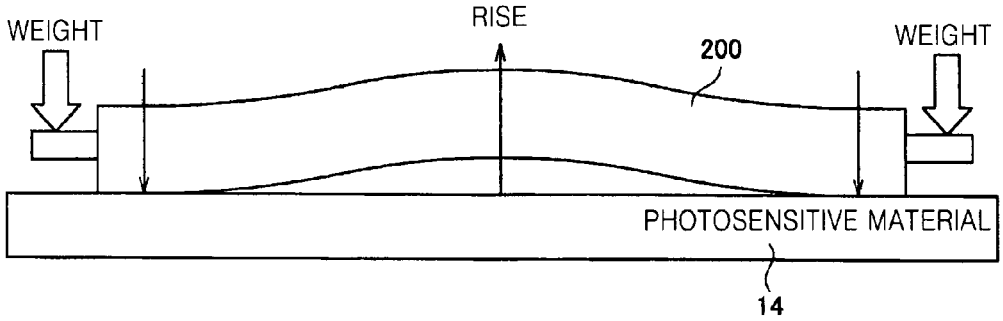
FIG. 5 is a schematic view of a conventional charging roller pressed against a photosensitive drum according to a comparative example.

FIG. 5 is a schematic view of a conventional charging roller pressed against a photosensitive drum according to a comparative example. In this case, when a weight is applied to a charging roller 200, a center of the charging roller 200 may be bent upward, thereby reducing pressure applied to the center of the charging roller 200.

Figure 6:
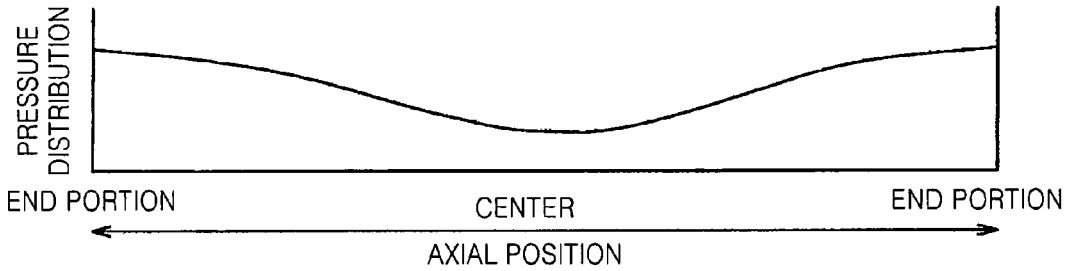
FIG. 6 is a graph showing distribution of pressure applied to a surface of a photosensitive drum in the comparative example of FIG. 5.

FIG. 6 is a graph showing distribution of pressure applied to a surface of a photosensitive drum in the comparative example of FIG. 5.

In FIG. 6, an abscissa denotes an axial position of the charging roller 200, and an ordinate denotes pressure. As shown in FIG. 6, since the center of the charging roller 200 rises and is bent upward, pressure applied to the center of the charging roller 200 may be reduced. For this reason, since uniform pressure cannot be applied along an axial direction of the charging roller 200, the photosensitive drum 14 cannot be uniformly electrified, and the surface of the photosensitive drum 14 cannot have a desired charging state. As a result, toner cannot be bonded to the photosensitive drum 14 in a desired state, thus causing deterioration of image quality.

Figure 7:
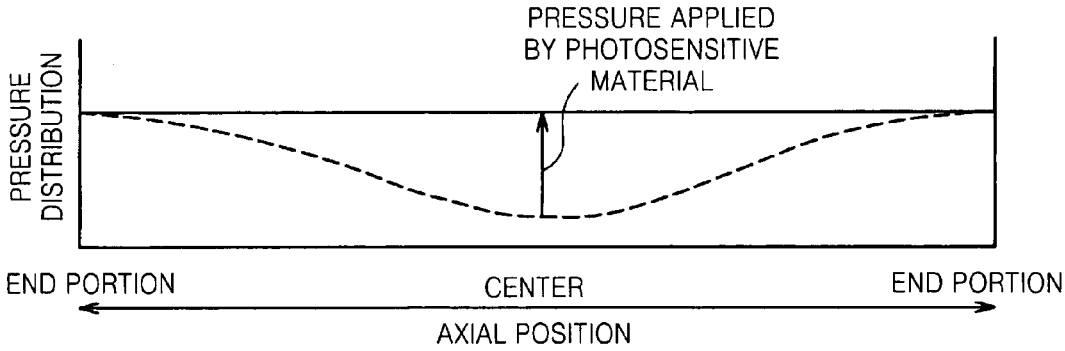
FIG. 7 is a graph showing distribution (denoted by a solid line) of pressure applied to a surface of a photosensitive drum when a charging roller according to an exemplary embodiment of the present disclosure is used.

FIG. 7 is a graph showing distribution (denoted by a solid line) of pressure applied to a surface of a photosensitive drum when a charging roller according to an embodiment of the present disclosure is used. As in FIG. 6, in FIG. 7, an abscissa denotes an axial position of the charging roller, and an ordinate denotes pressure. Also, a dotted line of FIG. 7 denotes the pressure distribution of the comparative example of FIG. 6.

As shown in FIG. 7, pressure applied to both ends of the charging roller 15 may be the same as in the comparative example of FIG. 6. Meanwhile, since the bent hollow roll 100 described in FIG. 4B is pressed against the photosensitive drum 14 and elastically deformed along the surface of the photosensitive drum 14 at the center of the charging roller 15, pressure applied to the center of the charging roller 15 may be higher than in the comparative example (as denoted by the dotted line of FIG. 7). Accordingly, by increasing the pressure applied to the center of the charging roller 15, uniform pressure may be obtained over an entire axial region.

Furthermore, in the above-described configuration, since the charging roller 15 includes a hollow roller, pressure (nip pressure) applied to the photosensitive drum 14 may be sufficiently reduced, and thus occurrence of troubles at a contact portion between the charging roller 15 and the photosensitive drum 14 may be reliably suppressed as compared with a conventional solid rubber roller.

In addition, since the flanges 102 having the rotation axes 104 are contacted under pressure to the photosensitive drum 14 and driven, the flanges 102 may be reliably driven by the photosensitive drum 14. Also, in the flanges 102 configured to broaden the hollow roll 100 inside the hollow roll 100, only portions of the flanges 102 relatively near the photosensitive drum 14 may be deformed due to applied pressure and have a bending force toward the center of the hollow roll 100. Also, by applying pressure to the center of the hollow roll 100, the bending force of the flanges 102 may be stabilized. Due to the bending force, pressure applied to the center of the charging roller 15 in the axial direction may be increased, and the applied pressure may be uniform.

Figure 8:
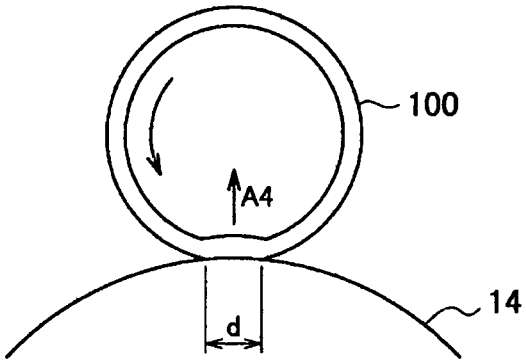
FIG. 8 is a schematic view showing that a contact portion between a hollow roller and a photosensitive drum is deformed along a surface of the photosensitive drum with rotation.

As shown in FIG. 8, since a contact portion between the hollow roll 100 and the photosensitive drum 14 is deformed due to rotation of the hollow roll 100 along the surface of the photosensitive drum 14 in the direction of an arrow A4, the hollow roll 100 may contact the surface of the photosensitive drum 14 by a predetermined width d in a circumferential direction of the photosensitive drum 4. Thus, the width d by which the hollow roll 100 contacts the surface of the photosensitive drum 14 may be greater than in the conventional charging roller 200, and pressure applied to the photosensitive drum 14 may be greatly reduced due to a synergetic effect between an increase in the width d and a reduction in applied pressure. Accordingly, stress applied to the photosensitive drum 14 may be suppressed, and damage to the photosensitive drum 14 may be reliably suppressed.

In addition, as shown in FIG. 8, the contact portion between the hollow roll 100 and the photosensitive drum 14 is deformed along the surface of the photosensitive drum 14 as rotation occurs so that the photosensitive drum 14 can be electrified due to not only occurrence of discharge in fine gaps disposed on opposite sides of the contact portion and but also injection of charges into the contact portion. Accordingly, even if the charging roller 15 has a very low electric potential, the surface of the photosensitive drum 14 may be electrified according to the electric potential of the charging roller 15. When a solid roller, such as the charging roller 200 according to the comparative example of FIG. 5, is used or a charging roller has a high hardness, since the contact portion between the charging roller and the photosensitive drum has a fine width, electrification caused by injection of charges cannot occur. Thus, it is necessary to induce discharge in a fine gap by sufficiently increasing an electric potential of a charging roller. In this case, the surface of the photosensitive drum 14 may be easily damaged.

Therefore, in the present embodiment, the charging roller 15 may be pressed under a low pressure (or low nip pressure) against the photosensitive drum 14 and simultaneously the charging roller 15 and the photosensitive drum 14 may contact each other by a great width (or nip width). Due to the above-described characteristics, a low-power charging device and an image forming apparatus using the same may be realized. In addition, through use of a simple configuration, the charging roller 15 may be reliably, driven by the photosensitive drum 14 and uniformly perform charging along an axial direction.

While the present disclosure has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A charging device having a roll shape and configured to contact an image receptor as a body to be charged and to be capable of rotating due to rotation of the image receptor, the charging device comprising:

a hollow roll having a cylindrical shape and formed of a hollow elastic member; and flanges having rotation axes and formed of elastic members, the flanges inserted into two ends of the hollow roll to increase an inner diameter of the hollow roll.

2. The device of claim 1, wherein the hollow roll and at least one of the flanges have conductivity.

3. The device of claim 1, wherein the flanges contact the image receptor via the hollow roll and are driven by rotation of the image receptor.

4. The device of claim 1, wherein the rotation axes of the flanges are pressed against the image receptor.

5. The device of claim 1, wherein the flanges are bonded to the hollow roll.

6. An image forming apparatus comprising:

an image receptor configured to transfer a supplied toner based on an electrostatic latent image and to form an image on a medium;

a developing agent receptor configured to supply the toner to the image receptor; and a charging roller configured to contact the image receptor, to rotate due to rotation of the image receptor, and to electrify the image receptor, wherein the charging roller comprises a hollow roll having a cylindrical shape and formed of a hollow elastic member; and flanges having rotation axes and formed of elastic members, the flanges inserted into two ends of the hollow roll to increase an inner diameter of the hollow roll.

7. The apparatus of claim 6, wherein the hollow roll and at least one of the flanges have conductivity.

8. The apparatus of claim 6, wherein the flanges contact the image receptor via the hollow roll and operate by rotation of the image receptor.

9. The apparatus of claim 6, wherein the rotation axes of the flanges are pressed against the image receptor.

10. The apparatus of claim 6, wherein the flanges are bonded to the hollow roll.

11. The apparatus of claim 6, wherein the hollow roll is formed of conductive rubber.

12. The apparatus of claim 6, wherein the flanges include conic lateral surfaces that are inserted into two ends of the hollow roll to broaden both ends of the hollow roll.

* * * * *